United States Patent [19]

Reuter et al.

[11] 4,233,191

[45] Nov. 11, 1980

[54] ELECTRICALLY CONDUCTIVE PLASTICS MATERIALS AND PROCESS FOR THEIR PRODUCTION

[75] Inventors: Franz G. Reuter, Lemförde; Tankred Menzel, Bad Essen, both of Fed. Rep. of Germany

[73] Assignee: Reuter Technologie GmbH, Lemförde, Fed. Rep. of Germany

[21] Appl. No.: 889,487

[22] Filed: Mar. 23, 1978

[51] Int. Cl.[2] ..... H01B 1/06

[52] U.S. Cl. ..... 252/511; 252/514; 264/104; 264/105; 264/308

[58] Field of Search ..... 252/511, 514; 264/104, 264/105, 308; 260/42.55, 42.56

[56] References Cited

U.S. PATENT DOCUMENTS

| | | | |
|---|---|---|---|
| 2,409,893 | 10/1946 | Pendleton et al. | 252/511 X |
| 3,274,323 | 9/1966 | Petriello | 264/308 |
| 3,294,733 | 12/1966 | Medalia et al. | 260/42.55 |
| 3,385,736 | 5/1968 | Deibert | 264/105 X |
| 3,518,116 | 6/1970 | Stock et al. | 252/511 X |
| 4,031,033 | 6/1977 | Budevski et al. | 252/511 |
| 4,051,094 | 9/1977 | Reuter et al. | 252/511 |
| 4,090,984 | 5/1978 | Lin et al. | 252/511 |
| 4,129,633 | 12/1978 | Biddick | 264/105 X |

FOREIGN PATENT DOCUMENTS

| | | | |
|---|---|---|---|
| 775042 | 1/1968 | Canada | 252/511 |

*Primary Examiner*—Benjamin R. Padgett
*Assistant Examiner*—J. L. Barr
*Attorney, Agent, or Firm*—Stevens, Davis, Miller & Mosher

[57] ABSTRACT

A method of producing electrically conductive plastics materials from polymers and electrically conductive particles wherein an aqueous dispersion of polyacrylate, such as a thermally cross-linkable copolymer based upon ethyl acrylate, or a polyisobutylene is mixed with an aqueous dispersion of electrically conductive particles such as noble metals, non-metallic materials coated with noble metals, or carbon, and the resulting mixture is spread out in a thin layer on a support, whereafter the water is evaporated at a temperature above the softening of the plastics material.

13 Claims, No Drawings

ELECTRICALLY CONDUCTIVE PLASTICS MATERIALS AND PROCESS FOR THEIR PRODUCTION

The present invention is concerned with electrically conductive plastics materials and with a process for the production thereof.

It is known to produce electrically conductive plastics materials by, for example, rolling or stirring electrically conductive carbon in the form of carbon black or graphite into plastics materials in a more or less plastic state. Because of the large surface area dimensions of carbon black, which are between 300 and 1500 square meters per gram, or of their high powder densities, it is not possible, even with the best stirring or mixing machines, to incorporate more than 15% by weight of carbon black in plastics materials without considerably affecting the original physical properties of the plastics materials. Permanent, stable conductivity can be ensured only with a carbon black content from about 25 to 30% by weight or even more.

In addition, it is known to disperse from 25 to 30% by weight of carbon black in organic solutions of thermoplastic and/or thermosetting plastics materials and then to evaporate the organic solvent in order to produce electrically conductive plastics materials. A disadvantage of this process is that large amounts of solvents have to be evaporated off, which entails the risk of explosions and/or which are toxic. Furthermore, the particles of carbon are partly encapsulated by the plastics material deposited upon evaporation of the solvent and the chains of carbon black particles still present, which provide the conductivity, are, to a large extent, destroyed again in subsequent calendering or during further processing by blow moulding, so that even with a carbon black content of to 30% by weight, conductivity is dependent upon the processing.

It is an object of the present invention to provide a process with which it is possible to work without the use of organic solvents and which process provides electrically conductive plastics materials, the electrical conductivity of which is retained even after further processing, for example by calendering, blow moulding, extrusion or injection moulding.

Thus, according to the present invention, there is provided a process of producing electrically conductive plastics materials from polymers and electrically conductive particles, wherein an aqueous dispersion of plastics materials is mixed with an aqueous dispersion of electrically conductive particles and the resulting mixture is spread out in a thin layer on a support, whereafter the water is evaporated at a temperature above the softening point of the plastics material.

The present invention also provides electrically conductive plastics materials obtained in this manner and the use thereof, for example, for the production of electrically conductive sheets and electrically conductive conveyor belts.

According to the present invention, the plastics pellets are not homogeneously filled with electrically conductive particles, such as carbon black, but merely coated on their surfaces. Due to plastic interflowing of the plastics pellets with the evaporation of the water, which is not harmful to the environment, there can be obtained, for example, an electrically conductive sheet on a fabric carrier band coated with teflon. After drying, the sheet can be stripped off the fabric carrier band, having been given a texture corresponding to that of the carrier band. In this case, which is a preferred embodiment of the present invention, the finished sheet is not subjected to the strain of further processing so that its conductivity is fully retained. By means of this process, it is possible to combine up to 50% by weight of carbon black with plastics materials, without the flexibility of the sheet being impaired. Because of the fabric-like texture of the sheet, the latter "hangs" considerably less rigidly than a non-textured material.

The method of the present invention for the production of electrically conductive plastics materials is, therefore, based upon mixing aqueous dispersions of plastics materials with aqueous dispersions of carbon black, which are commercially available, the selection of the plastics dispersion deciding the physical properties of the electrically conductive plastics materials and the type of carbon black and the quantities thereof deciding the conductivity of the sheet.

Plastics dispersions which can be used include, for example, those based on acrylic esters (for example, the "Acronals" marketed by BASF) and polyisobutylene (for example, "Oppanol" marketed by BASF) either singly or mixed with one another, preferred aqueous dispersions being those of age-resistant polyacrylates and of polyisobutylene. The carbon black used, which is preferably an acetylene carbon black in the form of a 30% by weight carbon black dispersion, is merely briefly mixed with a plastics dispersion in a stirrer. The low viscosity liquid and sprayable mixture obtained is sprayed on to a rotating conveyor belt by means of a spray gun situated on a spraying bridge. The conveyor belt can be, for example, a glass fibre fabric coated with teflon, with a width of 1 meter. The rotating fabric belt is guided through a drying tunnel with a length of about 5 meters, preferably at a temperature of from 100° to 130°, the water thereby being evaporated and cross-linking possibly taking place. Downstream of the drying zone, the sheet can be continuously stripped off and wound up or may be left for the time being on the belt. If the sheet is not stripped off, an increasingly thicker sheet or board, which can be used, for example, as a conductive conveyor belt, can be built up by repeated coating. From the thicker boards, it is possible, for example, to make stampings, such as heelpieces, sealing rings and the like. The electrically conductive plastics material can also be formed into chips or granules.

As previously stated, the electrically conductive plastics material can be up to 50% by weight of carbon black. A typical content would be over 25% by weight of carbon black and preferably 30–40% by weight of carbon black.

The electrically conductive particles may be of carbon, for example carbon black or graphite, of noble metals or of base metals coated with noble metals or of non-metallic substances. However, according to the present invention, it is preferable to use carbon black and particularly acetylene carbon black, such as is commercially available in the form of aqueous dispersions.

The following Examples are given for the purpose of illustrating the present invention.

EXAMPLE 1

Production of an electrically conductive cross-linked sheet 100 parts by weight of a 50% by weight aqueous dispersion of a copolymer capable of cross-linking at 120° C. and based upon ethyl acrylate are added to 100 parts by weight of a 30% by weight dispersion of carbon black and the two dispersions are mixed for 6 minutes in a slow-running stirrer. The final dispersion obtained, which has a viscosity of 60 cP, is fed to a spray gun. The spray gun, which has a fan type nozzle, is mounted on a carriage in such a manner that, during the spraying operation, the entire width of a belt running past it is wetted by the liquid dispersion. The conveyor belt running past under the spray gun has a width of 90 cm. The carrier conveyor belt is adjusted to a speed of 3 meters per minute by means of a continuously adjustable regulator. The carrier conveyor belt, which consist of a teflon-coated fabric band, is wetted on its upper face by the dispersion sprayed on to it. The wetted belt passes through a drying tunnel at a temperature of 120° C. After being dried, the sheet, which adheres only lightly to the conveyor belt, is stripped off. Depending upon the speed of the belt and the spraying adjustment, sheet weights of from 30 to 250 grams per square meter can be produced. The finished product is an elastic, permanently electrically conductive sheet having a fabric-like texture which retains its electrical conductivity even when subjected to either mechanical or thermal stressing. During the production process, no toxic gases are liberated, the system is not harmful to the environment and there is no danger of explosion in the installation. Calenders or blowing equipment or extruders preceding the installation are not required. The installation can also be used for other spraying and drying operations.

In addition to thin sheets, it is also possible to produce boards having a thickness of up to 4 mm., such as are required for producing stampings or for conductive conveyor belts. In this case, the sheet is stripped off from the carrier belt only after repeated coating or after several passages through the spraying plant.

EXAMPLE 2

Production of an electrically conductive copolymer capable of further thermoplastic processing and based upon ethyl acrylate.

An aqueous dispersion of a copolymer based upon ethyl acrylate is mixed with sufficient aqueous dispersion of carbon black to enable subsequent plastics material to contain 35% by weight of carbon black. It is thus ensured that the electrical conductivity will be retained even when the material is subjected to further processing in blow or injection moulding machines and presses. The mixture is made so highly viscous that the almost paste-like dispersion obtained can be spread out on to a belt coated with teflon. After passing through a drying tunnel at 100° C., i.e. at a temperature at which no cross-linking occurs, a sheet with a thickness of about 1 mm. is obtained which is electrically conductive and can be subjected to subsequent thermoplastic processing.

EXAMPLE 3

Production of a thermoplastic oil- and petrol-resistant tank with electrical conductivity properties.

As synthetic resin dispersion, a copolymer ("Acronal" 330D, marketed by BASF) is mixed with a synthetic resin dispersion (Propiofan 325D, marketed by BASF) in a weight ratio 1:1.5. Both these dispersions form oil- and petrol-resistant films. 50 parts by weight of a 45% by weight aqueous dispersion of carbon black are added to 100 parts by weight of this mixture and stirred for 10 minutes. The highly viscous mixture is spread on to a rotating teflon carrier belt, a layer with a thickness of about 1.5 mm. being formed. The coated belt passes through a drying tunnel which has forced ventilation and in which the drying temperature reaches precisely 100° C. so that practically no cross-linking occurs. During the drying, the water is evaporated out of the mixture. The dried material is readily removed from the teflon carrier belt and is then comminuted to such an extent that it can be passed through an extruder to a blow moulding plant. The material can be injection moulded and can also be worked up in press tools.

In accordance with the above described process, excellent physical properties can be obtained by mixing the most varied kinds of dispersions of plastics materials with one another. The method of the present invention enables permanent conductivity to be obtained, this conductivity also being retained even when the material is subjected to further processing in injection or blow moulding plants. The process is also not harmful to the environment because only water is liberated.

We claim:

1. A method of producing a thermoplastically further processable, electrically conductive plastic material from polymers and electrically conductive particles, comprising the steps of (1) mixing an aqueous dispersion of a thermoplastic synthetic resin with an aqueous dispersion of the electrically conductive particles, (2) spreading out the resulting mixture in a thin layer on a substrate, (3) subsequently evaporating water from the mixture at a temperature above the softening point of the synthetic resin, and (4) subsequently removing the formed electrically conductive plastic material layer from the substrate.

2. A method of producing a thermoplastically further processable, electrically conductive plastic material from polymers and electrically conductive particles, comprising the steps of (1) mixing an aqueous dispersion of a polyacrylate or a polyisobutylene synthetic resin with an aqueous dispersion of the electrically conductive particles, (2) spreading out the resulting mixture in a thin layer on a substrate, (3) subsequently evaporating water from the mixture at a temperature above the softening point of the synthetic resin, and (4) subsequently removing the formed electrically conductive plastic material layer from the substrate.

3. A method according to claim 1, wherein the aqueous dispersion of electrically conductive particles used is a dispersion in which the electrically conductive particles are noble metals, non-metallic materials coated with noble metals or carbon.

4. A method according to claims 3, wherein the carbon used is carbon black or graphite.

5. The method of claim 1 further comprising the step of repeating steps 1, 2 and 3 one or more times before performing step 4 until the electrically conductive plastic material layer has reached a desired thickness.

6. An electrically conductive thermoplastic material produced by the method of claim 1.

7. An electrically conductive thermoplastic material produced by the method of claim 5.

8. An electrically conductive plastics material according to claim 6, which is in the form of chips or granules.

9. An electrically conductive plastics material, according to claim 6, which contains at least 25% by weight of carbon black.

10. An electrically conductive plastics material according to claim 9, which contains from 30 to 40% by weight of carbon black.

11. A method as in claim 1 wherein said resultant mixture is sprayed in a thin layer on said substrate.

12. A method as in claim 1 wherein said substrate is a rotating conveyor belt and said resulting mixture is sprayed onto said belt, said belt rotating through a drying tunnel and said electrically conductive plastic material layer being removed from said belt after passing through said drying tunnel.

13. A method as in claim 1 wherein said resulting mixture is a liquid dispersion.

* * * * *